United States Patent [19]

Peignier et al.

[11] 4,227,883

[45] Oct. 14, 1980

[54] PROCESS AND COMPOSITION FOR CLEANING OR DE-OILING TEXTILE MATERIALS

[75] Inventors: Michel Peignier, Versailles; Claude Renault, Saint-Remy-Les Chevreuse, both of France

[73] Assignee: Rhone Poulenc Industries, Paris, France

[21] Appl. No.: 956,627

[22] Filed: Nov. 1, 1978

[30] Foreign Application Priority Data

Jun. 30, 1978 [FR] France ..... 78 19589

[51] Int. Cl.[2] ..... D06L 1/00

[52] U.S. Cl. ..... 8/142; 252/162; 252/171

[58] Field of Search ..... 252/171, 162; 8/142

[56] References Cited

U.S. PATENT DOCUMENTS

| | | | |
|---|---|---|---|
| 3,481,685 | 12/1969 | White | 8/142 |
| 4,014,805 | 3/1977 | Castrantas | 8/142 |

FOREIGN PATENT DOCUMENTS

| | | |
|---|---|---|
| 1386783 | 12/1964 | France . |
| 89341 | 5/1967 | France . |
| 1536343 | 7/1968 | France . |

*Primary Examiner*—Melvyn I. Marquis

*Attorney, Agent, or Firm*—McDougall, Hersh & Scott

[57] ABSTRACT

Process for anti-redeposition of staining substances on textiles of natural, synthetic or artificial fibers or mixtures thereof in the course of operations of dry cleaning or de-oiling by means of suitably stabilized perchloroethylene in which a sufficient amount of an additive represented by at least one monoketone compound having a boiling point below or equal to 160° C. and, preferably lower than 140° C., is added as an anti-redeposition additive.

12 Claims, No Drawings

PROCESS AND COMPOSITION FOR CLEANING OR DE-OILING TEXTILE MATERIALS

The present invention relates to a process for dry cleaning and de-oiling textiles, for the purpose of preventing stains from being redeposited on a textile substrate of natural, artificial or synthetic fibers or a mixture of such fibers, and thus holding the soil or staining substances of the substrate in suspension in the liquid bath in the course of the cleaning and de-oiling operation.

The invention also relates to a perchloroethylene-base composition for dry cleaning and de-oiling textiles and means for preventing the stains on a substrate from being redeposited thereon.

It is known that, when carrying out dry cleaning or de-oiling operations by means of perchloroethylene, on woven or knitted textiles, the stains which are removed from the textiles have a tendency to be redeposited on the textiles, particularly when the perchloroethylene is not regularly regenerated. This accentuates the phenomenon of "greying" of the textiles, which is more easily observed on white or light-colored fabrics.

The factors which may be involved in this redeposition are multiple and the complexity of the phenomenon depends mainly on the diversity of the fibers involved in the same cleaning baths, and on the hygrometry of the ambient atmosphere.

Various anti-redeposition agents have already been proposed for washing textiles in aqueous medium, in particular cellulose derivatives.

For the purpose of cleaning in organic solvent meduim, it is known from French Pat. No. 1.386.783 and its addition No. 89.341 that certain reinforcing agents have an anti-redeposition action, in particular, oxazines or substituted amides having more than 10 carbon atoms.

However, these agents whether those used in aqueous medium or those used in an organic solvent medium have the drawback of not being distillable. Accordingly, when regenerating the spent perchloroethylene by distillation, such agents remain at the bottom of the still with the soils or stains and other heavy residual substances, and can therefore no longer be recovered. In other words, these anti-redeposition agents of the prior art must be systematically added each time that the perchloroethylene is regenerated from the soiled solvent medium.

On the other hand, French Pat. No. 1.536.343 describes a dry cleaning process with comprises using perchloroethylene containing a lower alkanedione, such as 2,3-butanedione, 2,4-pentanedione, 2,5,-hexanedione or a cycloalkanedione such as 5,5-dimethyl 1,3-cyclohexanedione, in order to prevent polyvalent metal ion impurities from being deposited and which are responsible for the decrease in brightness of the materials cleaned, but have no active participation (or without taking any active part or share) in the conventional greying phenomenon.

The object of the present invention is to avoid redeposition and thus very considerably limit the "greying" phenomenon, during dry cleaning or de-oiling of textiles of synthetic artificial, natural or mixed fibers, while making it possible to recover and re-use the anti-redeposition agent of the invention, by distillation with the perchloroethylene in each bath regeneration stage.

The applicants have surprisingly found that it was possible very substantially to reduce the redeposition of staining matter, by using, in suitably stabilized perchloroethylene, at least one monoketone additive having a boiling point below or equal to 160° C. under normal pressure.

The invention therefore concerns a process for anti-redeposition of stains, when dry cleaning or de-oiling, by means of suitably stabilized perchloroethylene, the process being characterized in that in order to observe the desired effect of limiting the "greying" phenomenon of the textiles, a sufficient amount is added of an additive represented by at least one monoketone having a boiling point not in excess of 160° C., and preferably less than 140° C.

Such ketones may be selected from those represented by the general formula:

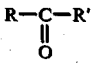

where R and R', which may be identical or different, represent $C_1$–$C_8$ alkyl, $C_1$–$C_8$ fluoro-, chloro- or bromo-alkyl, $C_2$–$C_8$ alkenyl, $C_2$–$C_8$ alkynyl, or a cyclopropyl group, or taken jointly R and R' represent a $C_5$–$C_6$ cycloalkyl group, a $C_5$–$C_8$ alkycycloalkyl or a $C_5$–$C_8$ alkenylcycloalkyl group.

The desired anti-redeposition effect becomes appreciable when at least 0.5 by weight of the monoketone additive is added to the stabilized perchloroethylene, and the optimum effect is generally secured for a concentration of up to 8% by weight, and preferably from 2 to 5% by weight.

The perchloroethylene may be stablized by any suitable stabilization agent, in particular those which are compatible with the presence of the above defined ketone additive such as, inter alia, and without this list of compounds being limiting: butylene oxide, triethylamine, tertio-butanol, N-methylpyrrole, n-butanol, diisobutylene, isopropyl acetate and more particularly epichlorohydrin, taken separately or in the form of a mixture of at least two of such compounds.

The anti-redeposition process according to the invention may also include the addition of auxiliary substances which are currently employed in dry cleaning, for example, cleaning reinforcing agents represented by anionic, cationic or non-ionic surface active agents, such as: alkysulphonates, alkylarylsulphonates, more particularly Ca dodecylbenzenesulphonate, products of ethoxylation of fatty alcohols and fatty acids, fatty alcohol sulphates, petroleum sulphonates, alkyl polyglycol ethers, alkylphenol polyglycol ethers, more particularly oxyethylenated nonylphenol having 12 ethylene oxide mols, color brightening agents, finishing agents, antistatic agents and water-proofing agents. Each of these auxiliary substances may be used in the usual proportions, for example from 1 to 10 g per liter of perchloroethylene-based bath, insofar as it is compatible with the presence of the monoketone additive of the invention as defined hereinabove.

In addition, the process of the invention may comprise the addition of water in proportions which may be up to about 5 to 6%, and more particulary from 2 to 3% by weight relative to the textiles to be cleaned. This water may originate from the moisture provided by the textiles themselves and/or by the commercial cleaning reinforcing agents which contain between 4 and 30% and usually from 8 to 14% of their weight of water. Occasionally additional amounts of water are added (about 2 to 4% by weight relative to the textiles to be cleaned) to the cleaning bath containing the reinforcing agents in order to improve the cleaning effect relative to so-called "meager" soiling substances.

The invention also concerns a composition or bath useful in dry cleaning or de-oiling textiles, to prevent "greying" or redepositon of stains on textiles comprising natural, artificial or synthetic fibers or mixtures of such fibers, during the dry cleaning or de-oiling operations, by means of suitably stabilized perchloroethylene possibly containing up to 6% by weight water, with respect to the textiles to be treated and the usual auxiliary substances, more particularly cleaning reinforcing and anti-static agents, in which each of said auxiliary substances may be present in amounts from 1 to 10 g per liter of said composition, which composition is characterized in that it contains, besides the perchloroethylene and its suitable stabilization agents, 0,5 to 8% and preferably from 2 to 5% by weight relative to said composition of at least one monoketone having a boiling point below or equal to 160° C. and, preferably, less than 140° C.

The monoketone may be selected from among those represented by the general formula:

$$R-\underset{\underset{O}{\|}}{C}-R'$$

where R and R' are as defined hereinabove.

The following are given by way of non-limiting examples illustrative of specific monoketones corresponding to the above general formula in which one or two or more thereof may be used in the practice of this invention: 2-propanone, 1-chloro,2-propanone, 1,1-dichloro-2-propanone, 1-bromo 2-propanone, 2-butanone,1-bromo 2-butanone, 1-butyne 3-one, 3-methyl 2-butanone, 3-methyl 3-butene 2-one, 3-pentene 2-one 2,4-dimethyl 3-pentanone, 4-methyl 3-pentene 2-one, 1-hexene 5-one, 2-hexanone, 3-hexanone, 5-methyl 2-hexanone, 5-methyl 3-hexanone, 4-heptanone, 2-methyl 4-heptanone, acetylcyclopropylketone, methylethylcyclopropylketone, methylethylcyclobutylketone, cyclopentanone, methylcyclopentanone and cyclohexanone.

In an advantageous embodiment of the invention, representative of the ketone used is 2-pentanone and/or 3-pentanone as the anti-redeposition additive.

In a preferred embodiment of the invention, the ketone used includes or consists essentially of 3—3 dimethyl 2-butanone.

The mode of operation permitting evaluation of the "greying" phenomenon of textiles, has been carried out through the use of a staining matter representative of a stain usually present on garments and having the following composition by weight:

| | Parts |
|---|---|
| Carpet beating dust screened at 26 mesh (0.63 mm) | 100 |
| Oil drained from a car engine | 100 |
| Lampblack (50%) crushed in 30 SAE engine oil (50%) | 4 |
| Oxyethylenated castor oil having 10 moles ethylene oxide | 5 |
| Distilled water | 50 |

-continued

| | Parts |
|---|---|
| Stabilized perchloroethylene | 155 |

The samples of textiles studied were the following:

100% polyester weighing 268 g/m2
100% 6/6 polyamide weighing 170 g/m2
100% polyacrylonitrile weighing 220 g/m2
100% wool weighing 280 g/m2
100% cotton weighing 110 g/m2

In order to evaluate the "greying" of textiles, the following were successively introduced in a laboratory washing drum:

225 cm2 of each of the samples of textiles just mentioned
1 liter of stabilized perchloroethylene-based composition in which 0.5 g of the staining matter defined hereabove was dispersed therein.

After treatment at a bath temperature of about 25° C. for a period of 5 minutes, the textile samples were centrifuged and dried at a temperature of 60° C. in a ventilated oven.

Each of the samples treated in this way, and "greyed" to a greater or lesser extent, was subjected to an operation of determining the reflectance index by means of the "Reflection meter 670" of the company "Photovolt" (United States of America) provided with a green filter.

The apparatus was set to 100 for each untreated textile, and a reflectance index was measured for each "greyed" sample.

The less the "greying" phenomenon, the closer this index will be to the value of 100.

In the following examples, which illustrate the various aspects of the invention in non-limiting manner, the stated percentages of the components of each composition are expressed by weight of the considered composition.

EXAMPLE 1

Using the mode of operation set out above, the "anti-greying" effect or anti-redeposition effect was examined of a composition based on initially stabilized perchloroethylene to which 5% acetone was incorporated as the "anti-greying" additive.

The starting perchlorethylene was stabilized by 0.0025% of triethylamine, 0.002% of N-methylpyrrole and 0.02% of n-butanol.

Following Table 1 summarizes the results obtained. This table also shows a reference test carried out with a composition which did not contain acetone according to the invention.

TABLE 1

| | Measure of reflectance index | | | | |
|---|---|---|---|---|---|
| | cotton | wool | poly-ester | polyacry-lonitrile | poly-amide |
| Reference blank | 83 | 90 | 71.5 | 75 | 93 |
| Perchloroethylene + 5% acetone | 91.5 | 98.5 | 96 | 88 | 98.5 |

EXAMPLE 2

The same operational conditions as in Example 1 were applied but using 2-butanone instead of acetone. Following Table 2 sets forth the results obtained:

TABLE 2

| | Measure of reflectance index | | | | |
|---|---|---|---|---|---|
| | cotton | Wool | poly-ester | polyacry-lonitrile | poly-amide |
| Reference blank | 89 | 86.5 | 70 | 72 | 91 |
| Perchloroethy-lene + 5% 2-bu-tanone | 90 | 97 | 90.5 | 80 | 97.5 |

EXAMPLE 3

Using the operational conditions as in Example 1, but in which the acetone was substituted by 3-methyl 2-butanone, the following results were obtained:

TABLE 3

| | Measure of reflectance index | | | | |
|---|---|---|---|---|---|
| | cotton | wool | polyester | polyacry-lonitrile | poly-amide |
| Reference blank | 87 | 92 | 73 | 69 | 91 |
| Perchloroethy-lene + 5%, 3-methyl 2-butanone | 87 | 98 | 82 | 77.5 | 97 |

EXAMPLE 4

By incorporating 3,3-dimethyl 2-butanone instead of acetone as anti-redeposition agent added to perchlorethylene stabilized as in Example 1, and by applying the same procedural steps as described in said example, the following results were observed:

TABLE 4

| | Measure of reflectance index | | | | |
|---|---|---|---|---|---|
| | cotton | wool | polyester | polyacry-lonitrile | polyamide |
| Reference blank | 89 | 86.5 | 70 | 72 | 91 |
| Perchloroethy-lene + 5% 3,3-dimethyl 2-buta-none | 90.5 | 96 | 83 | 79 | 97.5 |

EXAMPLE 5

Example 4 was repeated, but using a perchloroethylene base composition containing 2.5% of 3,3-dimethyl 2-butanone instead of 5%.

The results were the following:

TABLE 5

| | Measure of reflectance index | | | | |
|---|---|---|---|---|---|
| | cotton | wool | polyester | polyacry-lonitrile | poly-amide |
| Reference blank | 83 | 90 | 71,5 | 75 | 93 |
| Perchloroethy-lene + 2.5% 3,3-dimethyl 2-buta-none | 87.5 | 98.5 | 78.0 | 86.5 | 98 |

EXAMPLE 6

Using a dry-cleaning composition consisting essentially of 95% perchloroethylene stabilized as in Example 2, and 5% 2-pentanone, and employing the same procedural steps as in Example 1, the following results were obtained:

TABLE 6

| | Measure of reflectance index | | | | |
|---|---|---|---|---|---|
| | cotton | wool | polyester | polyacry-lonitrile | poly-amide |
| Reference blank | 89 | 86.5 | 70 | 72 | 91 |
| Perchloroethy-lene + 5% 2-pen-tanone | 91.5 | 97.5 | 84 | 76 | 95 |

EXAMPLE 7

Example 6 was repeated with 3-pentanone instead of 2-pentanone as the anti-redeposition additive. Table 7 illustrates the results obtained.

TABLE 7

| | Measure of reflectance index | | | | |
|---|---|---|---|---|---|
| | cotton | wool | polyester | polyacry-lonitrile | polyamide |
| Reference blank | 89 | 86.5 | 70 | 72 | 91 |
| Perchloroethy-lene + 5% 3-pentanone | 92 | 97.5 | 85 | 81 | 99 |

EXAMPLE 8

The same procedural steps as in Example 1 were applied except that the anti-redeposition additive was 4-methyl 2-penatnone. Table 8 illustrates the results secured:

TABLE 8

| | Measure of reflectance index | | | | |
|---|---|---|---|---|---|
| | cotton | wool | polyester | polyacry-lonitrile | polyamide |
| Reference blank | 89 | 86.5 | 70 | 72 | 91 |
| Perchloroethy-lene + 5% 4-methyl-2penta-none | 90.5 | 98 | 87.5 | 80 | 97 |

EXAMPLE 9

Example 8 was repeated but with only 2.5% instead of 5% 4-methyl 2-pentanone, in the dry cleaning composition.

TABLE 9

| | Measure of reflectance index | | | | |
|---|---|---|---|---|---|
| | cotton | wool | polyester | polyacry-lonitrile | poly-amide |
| Reference blank | 87 | 92 | 73 | 69 | 92 |
| Perchloroethylene + 2.5% 4-methyl-2-pentanone | 87 | 94 | 81 | 73 | 94.5 |

EXAMPLE 10

The following results were obtained using the same operational conditions as in Example 1, but with a dry-cleaning composition consisting essentially of 95% perchloroethylene (stabilized as in Example 1) and 5% 2,4-dimethyl 3-pentanone (DMP):

TABLE 10

| | Measure of reflectance index | | | | |
|---|---|---|---|---|---|
| | cotton | wool | polyester | polyacry-lonitrile | poly-amide |
| Reference blank | 80 | 90.5 | 73.5 | 73 | 91 |
| Perchloroethylene + 5% DMP | 86 | 89 | 74 | 85.5 | 98 |

EXAMPLE 11

By replacing 2,4-dimethyl 3-pentanone of the preceding example by 4-heptanone, the results were as follows:

TABLE 11

| | Measure of reflectance index | | | | |
|---|---|---|---|---|---|
| | cotton | wool | polyester | polyacry-lonitrile | poly-amide |
| Reference blank | 84 | 92 | 69 | 71 | 92 |
| Perchloroethylene +5% 4-heptanone | 89 | 97 | 75 | 81 | 96 |

EXAMPLE 12

By replacing 4-heptanone of the preceding example by cyclohexanone, the following results were observed:

TABLE 12

| | Measure of reflectance index | | | | |
|---|---|---|---|---|---|
| | cotton | wool | polyester | polyacry-lonitrile | poly-amide |
| Reference blank | 89 | 86.5 | 70 | 72 | 92 |
| Perchloroethylene +6% cyclohexa-none | 89.5 | 97 | 86 | 83.5 | 93 |

Above Examples 1–12 show in general the improvement in anti-redeposition which may be more marked, depending on the considered ketone and the treated textile material.

We claim:

1. A process for anti-redeposition, which has the effect of reducing greying by redeposition of staining substances on textiles of natural, synthetic or artificial fibers or mixtures thereof, in the course of operation of dry cleaning, or de-oiling by means of perchloroethylene, comprising incorporating in the perchloroethylene a sufficient anti-greying amount of at least one monoketone anti-redeposition additive having a boiling point which does not exceed 160° C. to observe the desired anti-redeposition effect.

2. A process as claimed in claim 1, in which the monoketone additive has a boiling point below 140° C.

3. An anti-redeposition process according to claim 1, in which the monoketone is a ketone represented by the general formula:

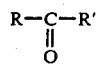

wherein R and R′ which may be identical or different represent $C_1$–$C_8$ alkyl, $C_1$–$C_8$ fluoro-, chloro- or bromo-alkyl, $C_2$–$C_8$ alkenyl, $C_2$–$C_8$ alkynyl or a cyclopropyl group, or taken jointly R and R′ represent a $C_5$–$C_6$ cycloalkyl group, a $C_5$–$C_8$ alkylcycloalkyl or a $C_5$–$C_8$ alkenylcycloalkyl group.

4. A process as claimed in claim 1, in which from 0.5 to 8% by weight of the anti-redeposition additive is incorporated in the perchloroethylene.

5. A process as claimed in claim 1, in which 2 to 5% by weight of the anti-redeposition additive is incorporated in the perchloroethylene.

6. A process as claimed in claim 1, in which the additive is 2-pentanone and/or 3-pentanone.

7. A process as claimed in claim 1, in which the additive is 3,3-dimethyl 2-butanone.

8. An anti-redeposition composition for dry cleaning or de-oiling based on stabilized perchloroethylene, which may contain water up to 6% by weight relative to the textiles to be treated, and auxiliary substances, including cleaning reinforcing agents and anti-static agents, each of which substances may be present in an amount of from 1 to 10 g per liter of said composition, characterized in that the composition contains from 0.5 to 8% by weight of at least one monoketone anti-redeposition additive having a boiling point below or equal to 160° C.

9. A composition as claimed in claim 8, in which the monoketone has a boiling point below 140° C.

10. An anti-redeposition composition as claimed in claim 8, in which the monoketone anti-redeposition additive is represented by the general formula:

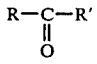

wherein R and R′ which may be identical or different represent $C_1$–$C_8$ alkyl, $C_1$–$C_8$ fluoro-, chloro- or bromo-alkyl, $C_2$–$C_8$ alkenyl, $C_2$–$C_8$ alkynyl or a cyclopropyl group, or taken jointly R and R′ represent a $C_5$–$C_6$ cycloalkyl group, a $C_5$–$C_8$ alkylcycloalkyl or a $C_5$–$C_8$ alkenylcycloalkyl group.

11. An anti-redeposition composition as claimed in claim 8, in which the monoketone additive is 2-pentanone and/or 3-pentanone.

12. An anti-redeposition composition as claimed in claim 8, in which the monoketone additive is 3,3-dimethyl 2-butanone.

* * * * *